US011841118B1

(12) United States Patent
Jacobs et al.

(10) Patent No.: US 11,841,118 B1
(45) Date of Patent: Dec. 12, 2023

(54) MODULAR LIGHT BAR ASSEMBLY

(71) Applicant: Soltech Solutions, LLC, Bethlehem, PA (US)

(72) Inventors: Justin Jacobs, Whitehall, PA (US); Michael Planer, Hellertown, PA (US); Matthew Napoli, Bethlehem, PA (US)

(73) Assignee: Soltech Solutions, LLC, Bethlehem, PA (US)

( * ) Notice: Subject to any disclaimer, the term of this patent is extended or adjusted under 35 U.S.C. 154(b) by 0 days.

(21) Appl. No.: 18/082,675

(22) Filed: Dec. 16, 2022

(51) Int. Cl.

| | |
|---|---|
| ***F21S 2/00*** | (2016.01) |
| ***F21S 4/28*** | (2016.01) |
| ***F21V 23/06*** | (2006.01) |
| ***F21V 17/10*** | (2006.01) |

(52) U.S. Cl.
CPC ..... *F21S 2/005* (2013.01); *F21S 4/28* (2016.01); *F21V 17/105* (2013.01); *F21V 23/06* (2013.01)

(58) Field of Classification Search
CPC ... H01R 13/6205; F21V 23/06; F21V 17/105; F21S 4/28; F21S 2/005
See application file for complete search history.

(56) References Cited

U.S. PATENT DOCUMENTS 10,707,610 B1 * 7/2020 Wang ..... H01R 13/6205

FOREIGN PATENT DOCUMENTS

CN 107110452 A * 8/2017 ..... F21K 9/20
WO WO-2016139449 A1 * 9/2016 ..... F21S 4/28

* cited by examiner

*Primary Examiner* — Anabel Ton
(74) *Attorney, Agent, or Firm* — Joseph E. Maenner; Maenner & Associates, LLC

(57) ABSTRACT

A modular light assembly provides an end bracket having a bracket housing. The housing has an open distal end and a closed proximal end. A closed end magnet is inserted the end bracket toward the closed proximal end. A non-magnetic ring is distal of the closed end magnet and closes the open distal end, An open end magnet is distal of the non-magnetic ring. An endcap is distal of the open end magnet and a light assembly extends distal of and connected to the endcap.

19 Claims, 8 Drawing Sheets

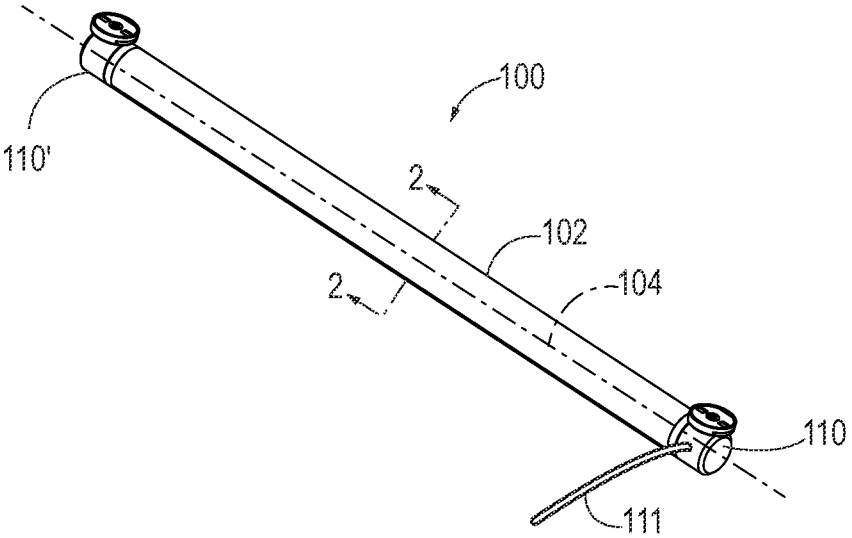
FIG. 1
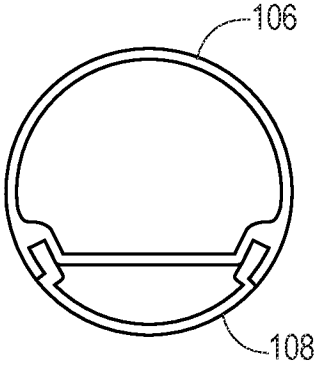
FIG. 2
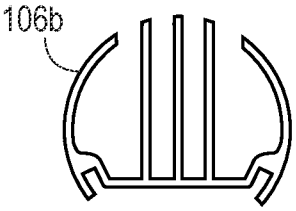
FIG. 2A
FIG. 2B
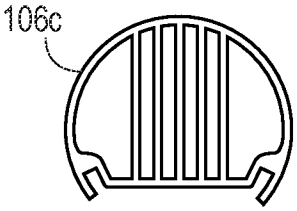
FIG. 2C
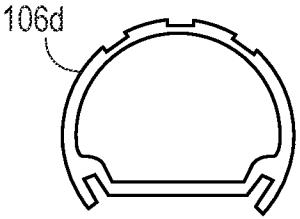
FIG. 2D

MODULAR LIGHT BAR ASSEMBLY

BACKGROUND OF THE INVENTION

Field of the Invention

The invention relates to a modular light assembly that allows for modular assembly.

Description of the Related Art

Bar lights are used to provide light along the length of the bar and can be used underneath cabinets, over plants as grow lights, or even merely suspended from a ceiling to provide light to an area below. Oftentimes, however, such lights are only uni-directional and cannot be moved, rotated, or otherwise adjusted to accommodate a specific lighting environment.

It would be beneficial to provide modular light bar system that can easily be replaced as well as easily rotated about its axis to direct light in a desired direction and location.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is modular light assembly including an end bracket having a bracket housing. The housing has an open distal end and a closed proximal end. A closed end magnet is inserted the end bracket toward the closed proximal end. A non-magnetic ring is distal of the closed end magnet and closes the open distal end. An open end magnet is distal of the non-magnetic ring. An endcap is distal of the open end magnet and a light assembly extends distal of and connected to the endcap.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIG. 1 is a perspective view of a magnetic modular bar light assembly according to an exemplary embodiment of the present invention;

FIG. 2 is a side elevation view, in section, of the light assembly of FIG. 1, taken along lines 2-2 of FIG. 1;

FIG. 2A is a side elevation view, in section, of an alternative construction of the light assembly of FIG. 1;

FIG. 2B is a side elevation view, in section, of an alternative construction of the light assembly of FIG. 1;

FIG. 2C is a side elevation view, in section, of an alternative construction of the light assembly of FIG. 1;

FIG. 2D is a side elevation view, in section, of an alternative construction of the light assembly of FIG. 1;

DETAILED DESCRIPTION

Figure 3:
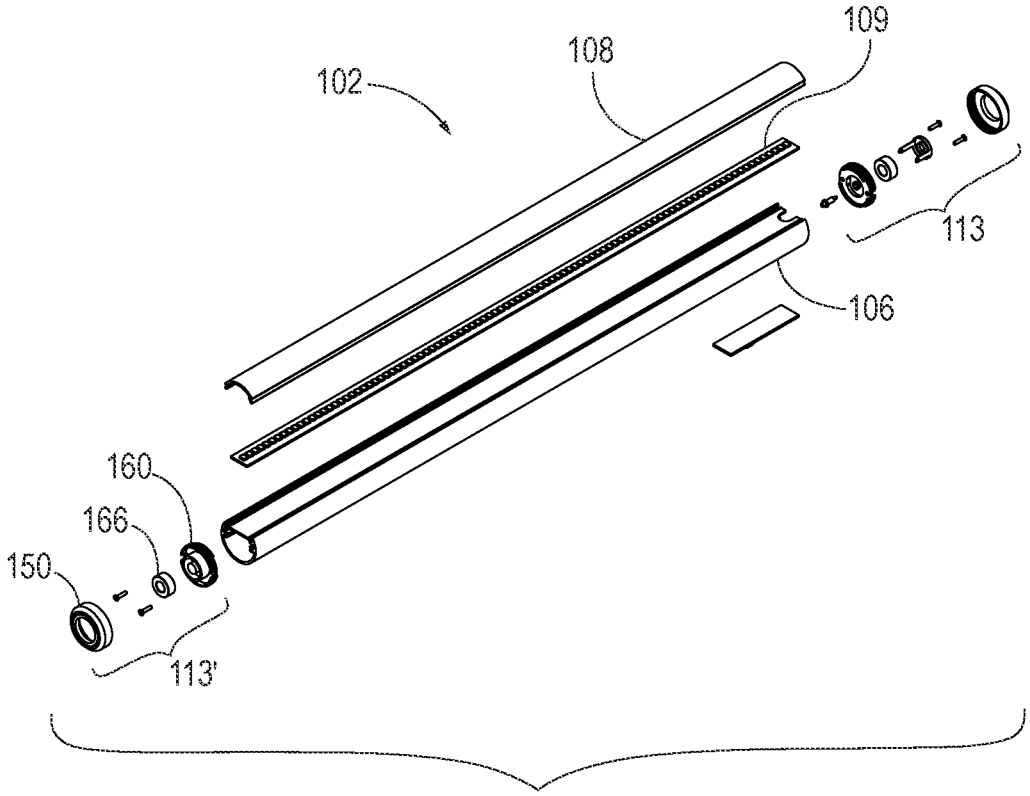
FIG. 3 is an exploded view of a light housing of the assembly of FIG. 1.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

The word "about" is used herein to include a value of +/−10 percent of the numerical value modified by the word "about" and the word "generally" is used herein to mean "without regard to particulars or exceptions."

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

A bar light assembly according to an exemplary embodiment of the present assembly provides for modularity for both a manufacturer and an end user. The system features aluminum extrusion housing with magnetic inserts on each end of the housing that are used to attach various brackets and supports for different installation requirements. The brackets pass electricity through to the light in the housing to reduce visible fasteners or wires, providing a sleek and low-profile design. Further, the design of the brackets allows for the light to be freely rotated about its longitudinal axis to adjust the angle of light being emitted. The assembly can be used as a grow light to enhance plant growth, or simply as a light to light up a room.

Referring to FIG. 1, a modular bar light assembly 100 ("assembly 100") according to the present invention is shown. Assembly 100 includes a light assembly 102 extending along a longitudinal axis 104. Light assembly 102 can be any desired length to fit the needs of a particular customer if required.

Referring to FIG. 2, an exemplary cross section of light assembly 102 is shown. Light assembly 102 includes an extrusion 106 and a lens 108 that covers an LED light strip 105, shown in FIG. 3, to protect LED light assembly 102 from the elements. FIGS. 2A-2D show alternative exemplary embodiments of extrusions 106A-106D that can be used to dissipate heat from LED light assembly 102. Those skilled in the art, however, will recognize that other heat dissipating designs can be used.

Assembly 100 also includes end brackets 110, 110' at each end of light assembly 102. End bracket 110 can include a power supply cable 111, while end bracket 110' does not include a power supply cable. Each end bracket 110 includes a subset 107 of assembly 100 and includes a bracket housing 112, a bracket insert 120 with a contact pin 130, a closed end magnet 126, and a closed end contact ring 140.

Figure 4:
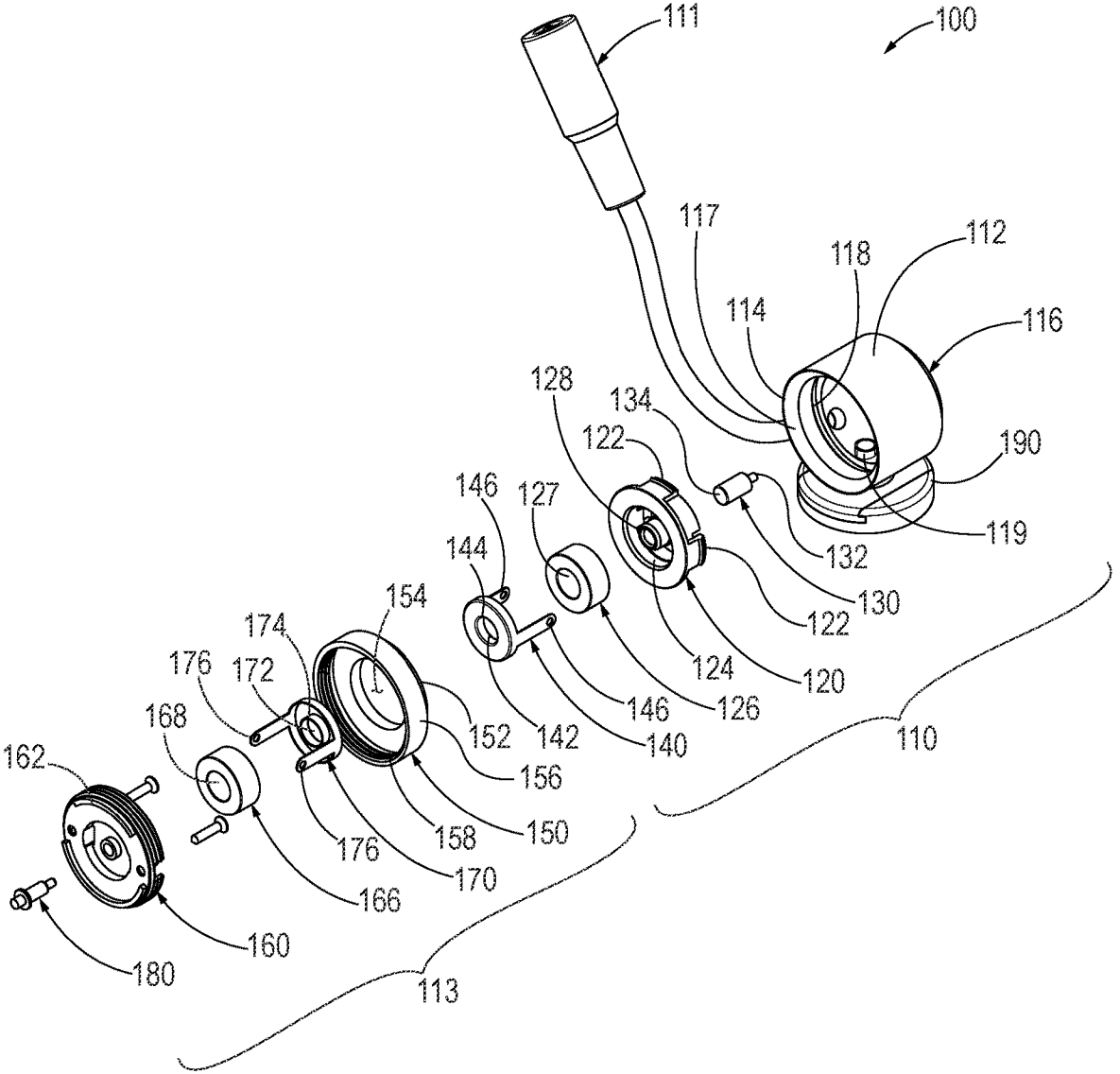
FIG. 4 is an exploded view of the light housing of the present invention, without the light housing.
Figure 5:
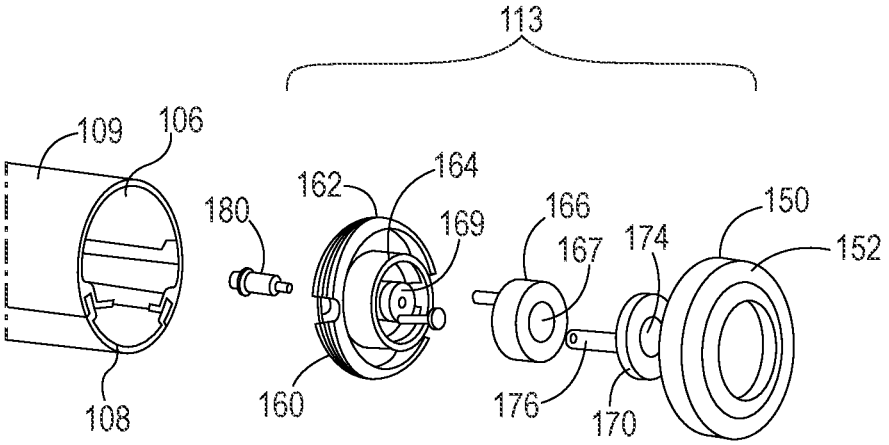
FIG. 5 is an exploded view of a light package of the present invention.
Figure 6:
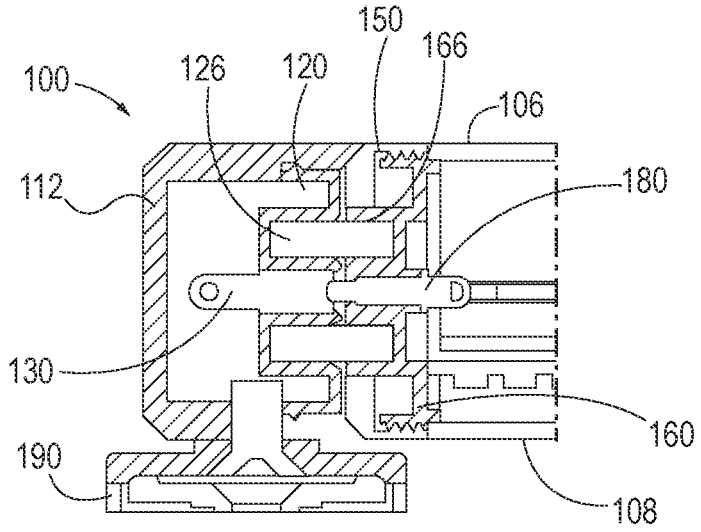
FIG. 6 is a side elevational view, in section, of the light assembly of the present invention.

Referring to FIGS. 4-6, end bracket 110 includes a bracket housing 112 having an open distal end 114 and a closed proximal end 116. Open distal end 114 includes a concave frusto-conical rim 117.

A bracket insert 120 is inserted into the bracket housing 112. Bracket housing 112 includes an annular slot 118 that accepts a plurality of bayonet clips 122 extending around a periphery of bracket insert 120 so that bracket insert 120 snaps into bracket housing 112 and allows bracket insert 120 to rotate about longitudinal axis 104 with respect to bracket housing 112. Bracket insert 120 can be constructed from a non-electrically conducting material, such as a polymer, to avoid conducting electricity therethrough.

Bracket housing 112 includes a threaded opening 119 that can be used to attach bracket housing 112 to various extensions, stands, flanges, fixtures, and bases, depending on the desired installation scheme for assembly 100.

Bracket insert 120 also includes an annular slot 124, distal from bayonet clips 122, configured to receive and support closed end magnet 126 that is inserted in the end bracket 110 toward the closed proximal end 116. Closed end magnet 126 has an annular shape with a central opening 127 so that closed end magnet 126 can rotate about a rim 128 that defines the inside of annular slot 124.

Contact pin 130 fits within and is attached to bracket insert 120. Contact pin 130 includes a proximal pin 132 and a distal contact face 134.

Closed end contact ring 140 is located distal of the closed end magnet 126. Closed end contact ring 140 fits over closed end magnet 126 and includes a central opening 142 defined by an inner rim 144 sized to fit into the central opening 127 of closed end magnet 126.

Closed end contact ring 140 can be constructed from an electrically conductive material, such as copper, and also includes a plurality of contact arms 146 that extend into bracket housing 116 and provide for an electrical connection to power supply cable 111.

Light assembly 102 includes the remaining elements of assembly 100 in a light package 113, including a non-magnetic ring 150, end cap 160, an open end magnet 166, an open end contact ring 170, and a pogo pin 180 extending through end cap 160.

Non-magnetic ring 150 is located distal of closed end magnet 126. Non-magnetic ring 150 has a convex frusto-conical rim 152 that mates with concave frusto-conical rim 117 of bracket housing 112 such that non-magnetic ring 150 can rotate within bracket housing 112. Non-magnetic ring 150 also has a central opening 154 extending therethrough and a female thread 158 inside body 156 of ring 150.

Endcap 160 is located distal of non-magnetic ring 150 and includes a male thread 162 for threaded engagement with female thread 158 on non-magnetic ring 150. Endcap 160 further includes an annular slot 164 configured to receive and support open end magnet 166 that is inserted in the endcap 160.

Open end magnet 166 is located generally between non-magnetic ring 150 and endcap 160 such that endcap 160 is distal of the open end magnet 166.

Open end magnet 166 is sized to fit through central opening 154 of non-magnetic ring 150. Open end magnet 166 has an annular shape with a central opening 168 so that open end magnet 166 can rotate about a rim 169 that defines the inside of annular slot 164.

Open end contact ring 170 is located distal of closed end contact ring 140. Open end contact ring 170 fits over open end magnet 166 and includes a central opening 172 defined by an inner rim 174 sized to fit into the central opening 168 of closed end magnet 166.

Open end contact ring 170 can be constructed from an electrically conductive material, such as copper, and also includes a plurality of contact arms 176 that extend into endcap 160 and provide for an electrical connection LED light assembly 102.

Open end contact ring 170 and closed end contact ring 140 are in sliding engagement with each other through the central opening 154 in non-magnetic ring 150.

Pogo pin 180 is connected to endcap 160. Pogo pin 180 includes a biasing member (not shown) such that pogo pin 180 is operable between a contact position wherein pogo pin 180 is in contact with contact face 134 on contact pin 130 and a non-contact position wherein pogo pin 180 is not in contact with contact face 134 on contact pin 130. When light assembly 102 is installed in bracket housing 112, pogo pin 180 contacts contact pin 130 and provides an electrical connection from endcap 160 to LED light assembly 102.

Also, when light assembly 102 is installed in bracket housing 112, light assembly 102 extends distal of and is connected to endcap 160 and rotates with non-magnetic ring 150 in bracket housing 112.

Figure 7:
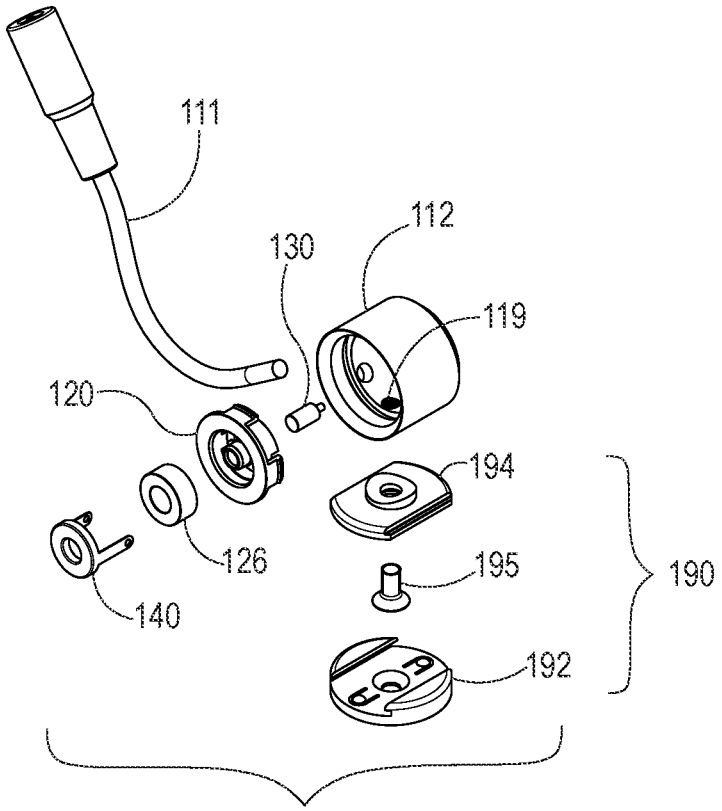
FIG. 7 is an exploded view of the end bracket and bracket base assembly of the present invention.

Referring to FIG. 7, a bracket base assembly 190 can be attached to bracket housing 112 via threaded opening 119. Bracket base assembly 190 includes a base 192 configured to be attached to a fixture (not shown) and an interbody 194 releasably connected to the base 192. Interbody 194 is connected to bracket housing 112 via a screw 195 that extends through a through-opening 196 in base 192 and a co-linear through-opening 198 in interbody 194, for threading into threaded opening 119 in bracket housing 112.

Figure 8:
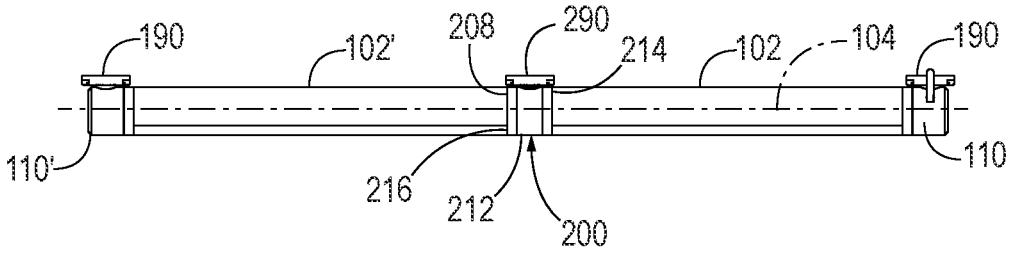
FIG. 8 is a side elevational view of an alternative embodiment of a magnetic modular bar light assembly of the present invention.
Figure 9:
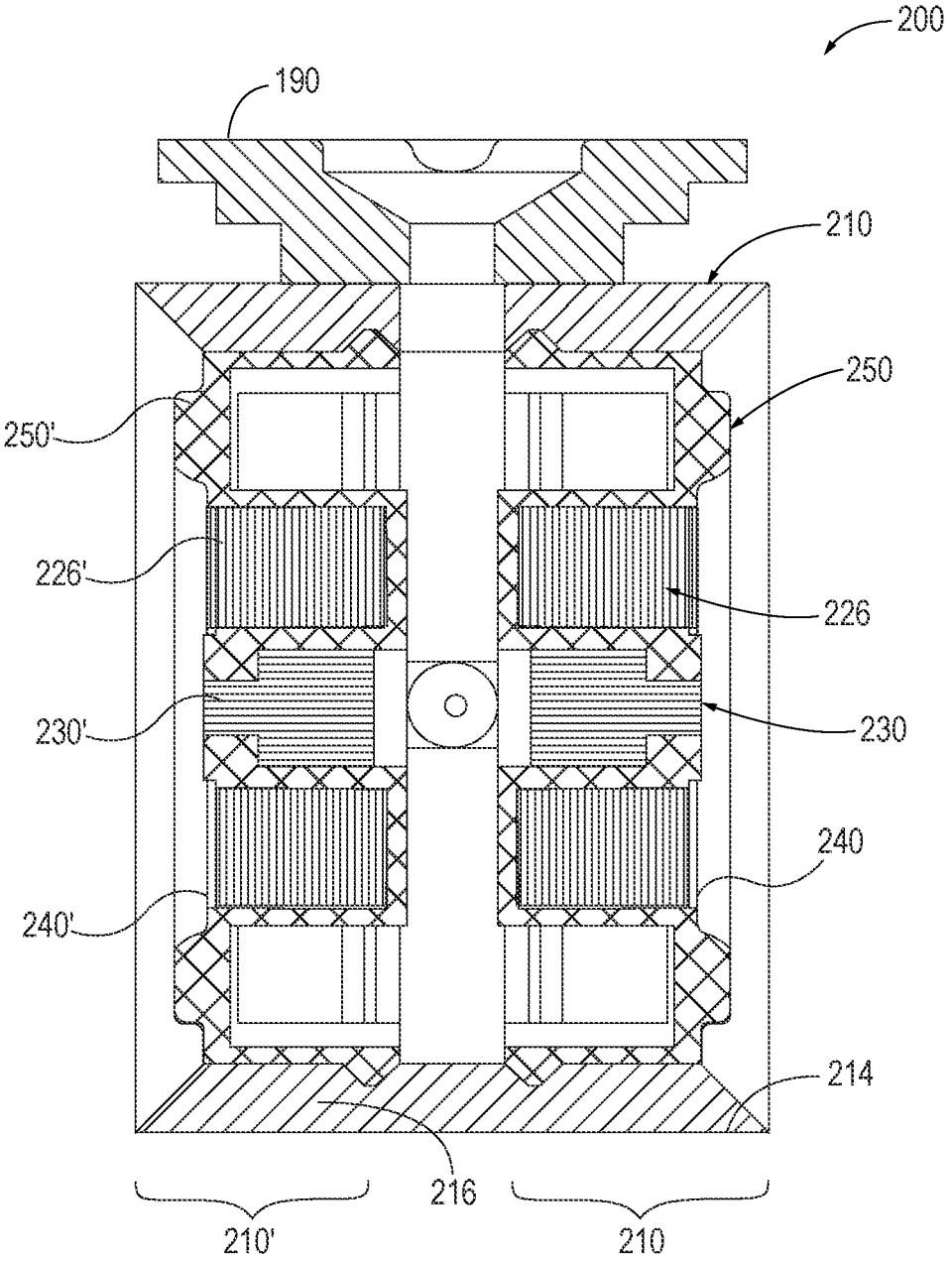
FIG. 9 is a side elevational view, in section of a central bracket of the assembly of FIG. 8.
Figure 10:
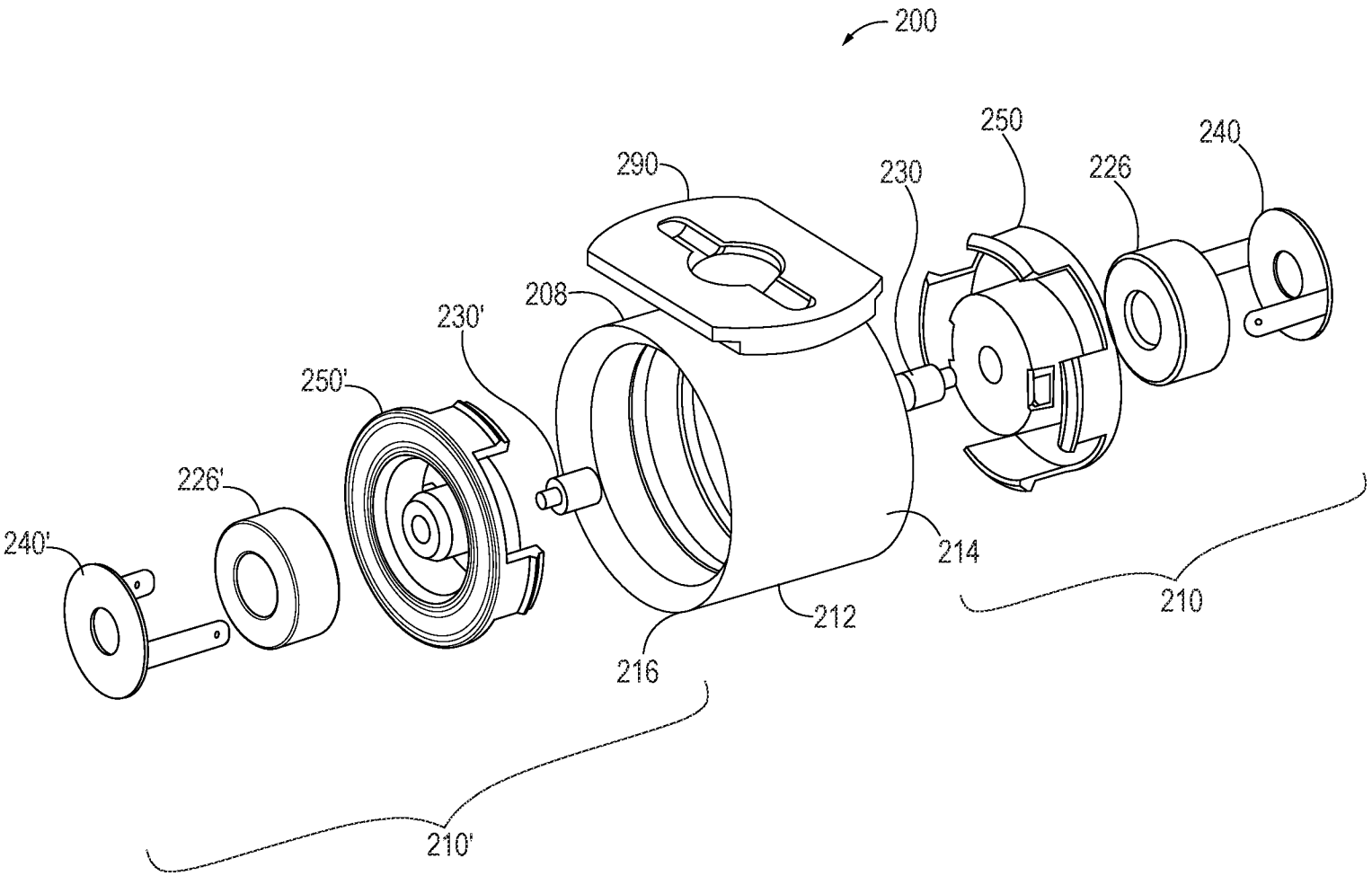
FIG. 10 is an exploded view of the central bracket of FIG. 9.

Referring to FIGS. 8-10, a modular light assembly 200 ("assembly 200") according to the present invention is shown. Assembly 200 can be used to connect two LED light assemblies 109, 109' together, one on either side of a support bracket 208. Ends of light assemblies 109, 109' distal from support bracket 208 are supported by end brackets 110, 110'.

Support bracket 208 includes a bracket housing 212 having a first end 214 and a second end 216. Each end 214, 216 includes an end bracket 210, 210', respectively, that have the same components as end bracket 110, namely, a first magnet 226, 226' a non-magnetic ring 250, 250' a contact pin 230, 230' and a contact ring 240, 240'. The components are identical to and assembled the same way as the components of end bracket 110, as described above. Contact pin 230' provides for electrical power from contact pin 230 and light assembly 102 to light assembly 102'

Each of LED light assembly 102 and second LED light assembly 102' rotates with its respective non-magnetic ring 250, 250' in support bracket 212. Light assemblies 109, 109' can rotate together or independently of each other.

Figure 11:
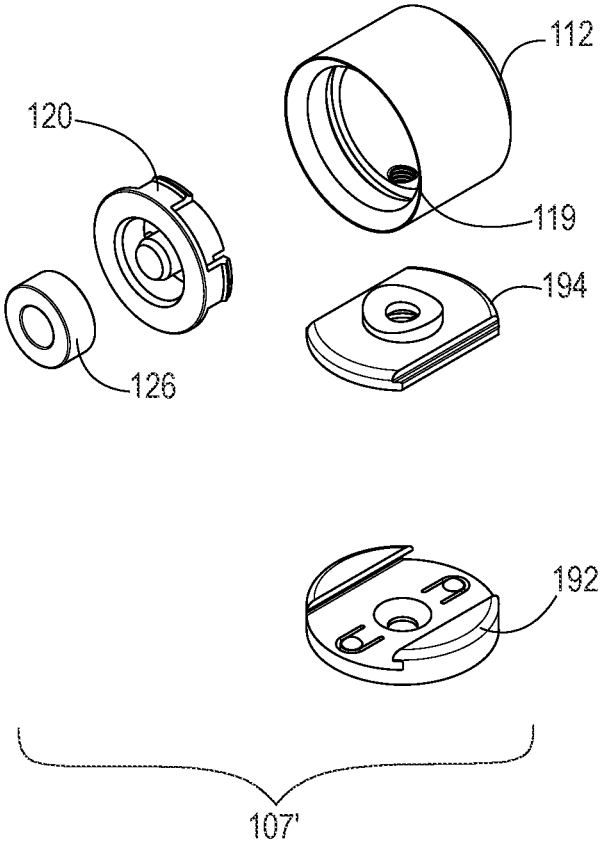
FIG. 11 is an exploded view of a non-electrically powered end bracket for use with the assembly of either FIG. 1 or FIG. 8.

Referring to FIGS. 3 and 11, non-electrical end bracket 110' is shown. End bracket 110' does not conduct any electrical power therethrough and, consequently, does not need all of the elements of end bracket 110. Referring to FIG. 3, light package 113' includes all of the elements of light package 113 with the exception of power supply cable 111, contact pin 130, and closed end contact ring 140, while subset 107' includes all of the elements of subset 107, with the exception of open end contact ring 170 and pogo pin 180.

While a magnetic connector is shown, those skilled in the art will recognize that other types of connectors for supporting light assembly 102 in brackets 110, 110' can be used, including, but not limited to well-known barrel connectors.

It will be further understood that various changes in the details, materials, and arrangements of the parts which have been described and illustrated in order to explain the nature of this invention may be made by those skilled in the art without departing from the scope of the invention as expressed in the following claims.

We claim:

1. A modular light assembly comprising:
- an end bracket comprising:
  - a bracket housing having an open distal end and a proximal end;
  - a closed end magnet inserted the end bracket toward the closed proximal end; and
  - a non-magnetic ring distal of the closed end magnet and closes the open distal end;
- an open end magnet distal of the non-magnetic ring;
- an endcap distal of the open end magnet; and
- a light housing extending distal of and connected to the first endcap.

2. The modular light assembly according to claim 1, wherein the non-magnetic ring has a central opening extending therethrough.

3. The modular light assembly according to claim 2, further comprising a closed end contact ring distal of the closed end magnet and an open end contact ring proximal of the open end magnet, the closed end contact ring and the open end contact ring being in sliding engagement with each other through the central opening.

4. The modular light assembly according to claim 1, further comprising a bracket base assembly attached to the bracket housing.

5. The modular light assembly according to claim 4, wherein the bracket base assembly comprises a base configured to be attached to a fixture and an interbody releasably connected to the base, the interbody connected to the bracket housing.

6. The modular light assembly according to claim 1, wherein the non-magnetic ring rotates within the bracket housing.

7. The modular light assembly according to claim 6, wherein the light housing rotates with the non-magnetic ring.

8. The modular light assembly according to claim 1, wherein the second end comprises a closed end.

9. The modular light assembly according to claim 1, further comprising a bracket insert inserted into the bracket housing, the bracket insert supporting the closed end magnet.

10. The modular light assembly according to claim 9, further comprising a contact pin attached to the bracket insert.

11. The modular light assembly according to claim 10, further comprising a pogo pin connected to the endcap, the pogo pin operable between a contact position wherein the pogo pin is in contact with the contact pin and a non-contact position wherein the pogo pin is not in contact with the contact pin.

12. The modular light assembly according to claim 9, wherein the bracket insert snaps into the bracket housing.

13. A modular light assembly comprising:
- a support bracket comprising:
  - a bracket housing having a first end and a second end;
  - a first magnet at the first end;
  - a non-magnetic ring distal of the first magnet wherein the non-magnetic ring has a central opening extending therethrough; and
  - a second magnet distal of the non-magnetic ring;
- a first light housing extending distal of and connected to the first end; and
- a bracket base assembly releasably connected to the support bracket.

14. The modular light assembly according to claim 13, further comprising a second light assembly connected to the second end.

15. The modular light assembly according to claim 14, wherein the non-magnetic ring rotates within the bracket housing.

16. The modular light assembly according to claim 15, wherein the first light assembly rotates with the non-magnetic ring.

17. The modular light assembly according to claim 15, wherein the second light assembly rotates with the non-magnetic ring.

18. The modular light assembly according to claim 13, further comprising a first contact ring distal of the first magnet and a second contact ring proximal of the first magnet, the first contact ring and the second contact ring being in sliding engagement with each other through the central opening.

19. The modular light assembly according to claim 13, wherein the second end comprises a closed end.

* * * * *